US005563390A

United States Patent [19]

Demissy

[11] Patent Number: 5,563,390

[45] Date of Patent: Oct. 8, 1996

[54] ACTUATING MECHANISM FOR ACTUATING A PROTECTIVE INTERRUPTING CHAMBER

[75] Inventor: Daniel Demissy, Montreal, Canada

[73] Assignee: GEC Alsthom T & D Inc., Quebec, Canada

[21] Appl. No.: 379,965

[22] Filed: Jan. 27, 1995

[30] Foreign Application Priority Data

Feb. 1, 1994 [FR] France ..... 94 01071

[51] Int. Cl.[6] ..... H01H 33/42; H01H 77/04; H01H 81/02

[52] U.S. Cl. ..... 218/154; 218/140; 337/130; 337/139

[58] Field of Search ..... 200/17 R; 218/1, 218/2, 7, 8, 14, 43, 45, 55, 68, 78, 79, 80, 84, 91, 92, 118, 119, 120, 140, 152, 153, 154; 337/139, 140, 126–130

[56] References Cited

U.S. PATENT DOCUMENTS

| | | | |
|---|---|---|---|
| 4,371,791 | 2/1983 | Mercier | 307/141 |
| 4,570,143 | 2/1986 | Bridges et al. | 337/75 |
| 4,713,643 | 12/1987 | Baum et al. | 337/140 |
| 4,865,521 | 9/1989 | Ise et al. | 417/187 |
| 4,973,931 | 11/1990 | Herbert | 337/139 |

FOREIGN PATENT DOCUMENTS

| | | | |
|---|---|---|---|
| 0221430A1 | 5/1987 | European Pat. Off. | H01H 3/30 |
| 2928799A1 | 1/1980 | Germany | H01H 71/24 |

*Primary Examiner*—Brian W. Brown
*Assistant Examiner*—Michael A. Friedhofer
*Attorney, Agent, or Firm*—Sughrue, Mion, Zinn, Macpeak & Seas

[57] ABSTRACT

The present invention relates to an actuating mechanism for actuating the moving contact of a protective interrupting chamber which is installed on a high-voltage or medium-voltage power line and which is to be opened when a current in excess of a surge current threshold flows through line, the mechanism including a drive member for driving a displacement device for displacing the contact. The drive member is a conductive helical spring made of a shape memory alloy and electrically coupled to the line, a current in excess of said surge current threshold passing through the spring heating said spring to such an extent that said alloy goes from its martensitic phase to its austenitic phase. The mechanism enables the interrupting chamber to be re-closed by means of a sequencer device associated with the displacement device, and providing an adjustable and timed opening and closing cycle.

8 Claims, 8 Drawing Sheets

ACTUATING MECHANISM FOR ACTUATING A PROTECTIVE INTERRUPTING CHAMBER

FIELD OF THE INVENTION

The present invention relates to an actuating mechanism for actuating a protective interrupting chamber.

More precisely, the present invention concerns an actuating mechanism for actuating the moving contact of a protective interrupting chamber which is installed on a power line and which is to be opened when a current in excess of a surge current threshold flows through line, the mechanism including a drive member for driving a displacement device for displacing the contact.

BACKGROUND OF THE INVENTION

When a fault appears on the line, the fault, e.g. a short-circuit, must be detected, and the interrupting chamber must be opened. Once the fault current has disappeared, the chamber must be re-closed. Conventionally, such detection and control is performed by means of electronic systems, with energy being provided externally.

OBJECTS AND SUMMARY OF THE INVENTION

An object of the present invention is to provide such a mechanism that is particularly simple and reliable, and that requires no external control system.

To this end, the invention provides that the drive member is a conductive helical spring made of a shape memory alloy and electrically coupled to the line, a current in excess of said surge current threshold passing through the spring heating said spring to such an extent that said alloy goes from its martensitic phase to its austenitic phase, and that the mechanism enables the interrupting chamber to be re-closed by means of a sequencer device associated with the displacement device, and providing an adjustable and timed opening and closing cycle.

In this way, the specific properties of shape memory alloys are used together with suitable dimensioning of the spring, so that, under the effect of a fault current, e.g. ten times the rated current, the spring is heated to a level such that the alloy goes from the martensitic phase to the austenitic phase, thereby causing the spring to change shape (from a relaxed state to a compressed state or vice versa), and activating the displacement device so that the interrupting chamber is opened.

Moreover, the mechanism includes a sequencer device which firstly applies time-delays to re-closing and optionally to re-opening the interrupting chamber in an adjustable opening and closing cycle, e.g. in a cycle such as O-2s-CO-10s-CO-20s-C, and secondly, when the fault persists, locks the mechanism in the open position.

In a preferred embodiment of the invention, the displacement device is a snap-acting mechanism toggling on either side of a dead center, it is connected to the moving contact, and it is displaceable from a first position, in which it pushes the contact to the closed position, to a second position in which it pulls the contact to the open position under the effect of the spring made of a shape memory alloy being compressed, which spring is connected at one of its ends to a fixed support portion, and at its other end to the displacement device via a rod mounted to slide inside the spring and coming into abutment at said other end when the spring is relaxed.

The displacement device includes two arms comprising a single part that is mounted to rotate about an axis, a first one of the arms being urged to rotate by a traction spring and being connected to the moving contact via a pivotally-mounted connection rod, and via a unit comprising a guided part that is guided in a guide rigidly connected to the contact, which guided part is urged by a compression spring and is provided with an oblong hole along which the pivot pin of the connection rod can slide, and the second arm being secured to the slidably-mounted rod.

The sequencer device includes at least one retractable cam that is retractable via time-delay means, against which cam a catch fixed to the free end of the slidably-mounted rod is engaged in traction, and against which cam a roller also fixed to the free end of the slidably-mounted rod is engaged in thrust.

Preferably the sequencer device includes a plurality of retractable cams lined up around a rotary wheel subjected to a return spring, and a catch mounted to pivot about a fixed axis and retaining one of the cams against the action of the return spring.

The sequencer device also includes two non-retractable end-of-stroke locking cams.

To enable the mechanism to be reset manually, the sequencer device includes independent means for manually disengaging all of the cams so as to reset the mechanism at the end of a cycle.

To enable the mechanism to be reset automatically, the sequencer device includes independent means for automatically disengaging the cams so as to reset the mechanism during a cycle, which means comprise a pneumatic actuator fed with gas via a valve controlled by a pneumatic time-delay member, via a compression chamber in which a piston coupled to the displacement device is slidably mounted.

BRIEF DESCRIPTION OF THE DRAWINGS

A preferred embodiment of the invention is described below in more detail with reference to the accompanying drawings, in which.

MORE DETAILED DESCRIPTION

Figure 1:
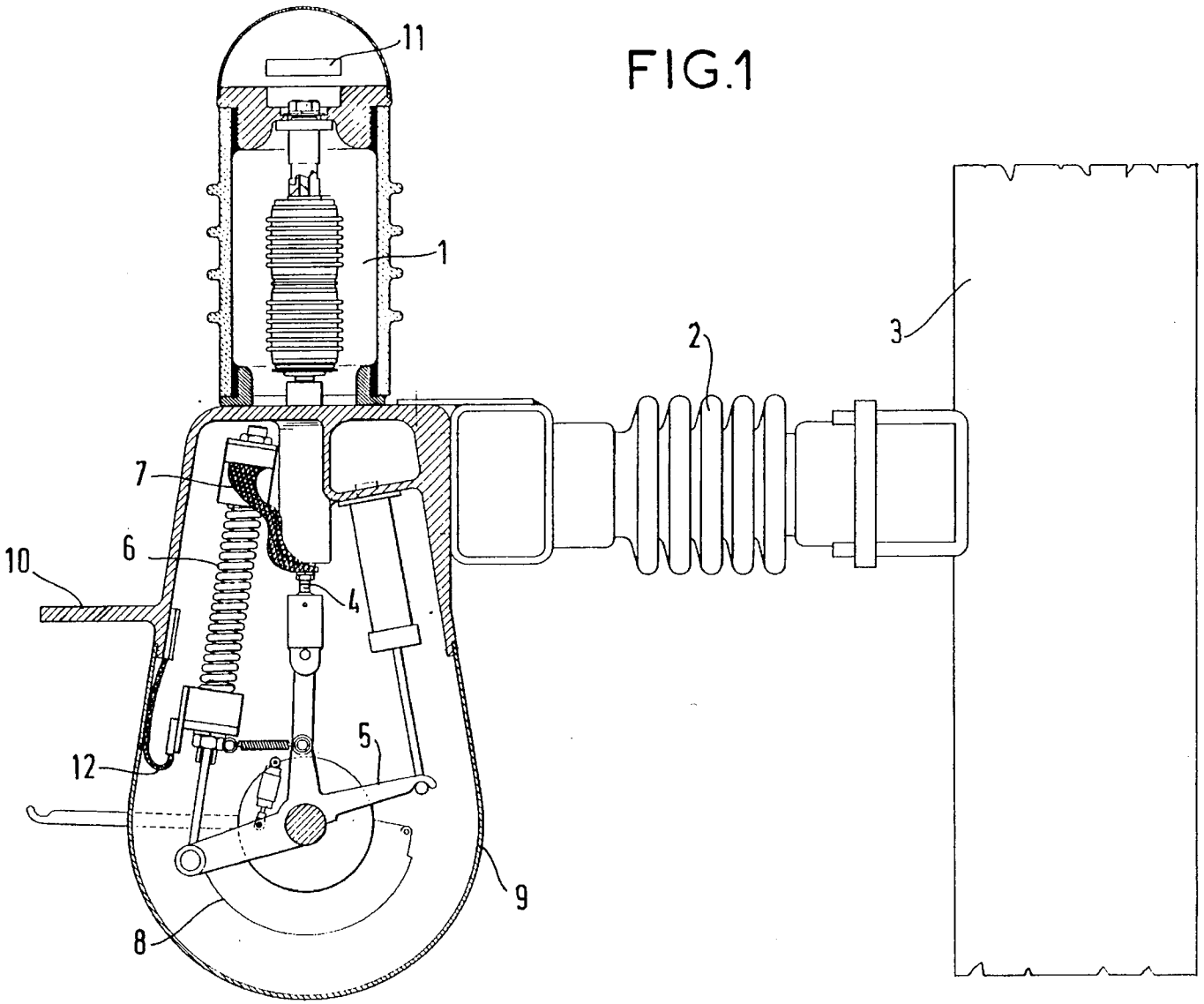
FIG. 1 is a vertical section view through a mechanism of the invention mounted on a vacuum interrupting chamber.

FIG. 1 shows an overall view of the actuating mechanism as mounted on a protective interrupting chamber which is installed on an power line and which is to be opened when a current in excess of a surge current threshold (e.g. 10 times the rated current) flows through line. In the example shown, the chamber is a vacuum interrupting chamber 1 and it is connected to a first terminal 11. The resulting assembly is supported by an insulator 2 on a support structure 3. The moving contact of the vacuum chamber 1 is secured to a drive rod 4 connected to a displacement device 5 driven by a drive member constituted by a conductive helical spring 6 made of a shape memory alloy (referred to as an "SMA" spring) and having a force of about 400 N, for example. The spring is electrically coupled to the line via a braid 7 which connects one end of the spring to the output of the drive rod 4. On passing a current in excess of said surge current threshold, the spring is heated to such an extent that said alloy goes from its martensitic phase to its austenitic phase. In the martensitic phase, the spring 6 is relaxed as shown in FIG. 1.

The mechanism enables the interrupting chamber 1 to be re-closed via a sequencer device 8 associated with the displacement device 5, and providing an adjustable and timed opening and closing cycle. In the example shown, the opening and closing cycle is as follows: O-2s-CO-10s-CO-20s-C, and when the fault persists, the sequencer locks the mechanism in the open position.

The mechanism is received inside a casing 9 which supports a second terminal 10 connected via another conductive braid 12 to the other end of the SMA spring 6.

The mechanism and the various stages of the cycle are described below in more detail.

The displacement device 5 is described first, with reference to FIGS. 2 to 9.

Figure 2:
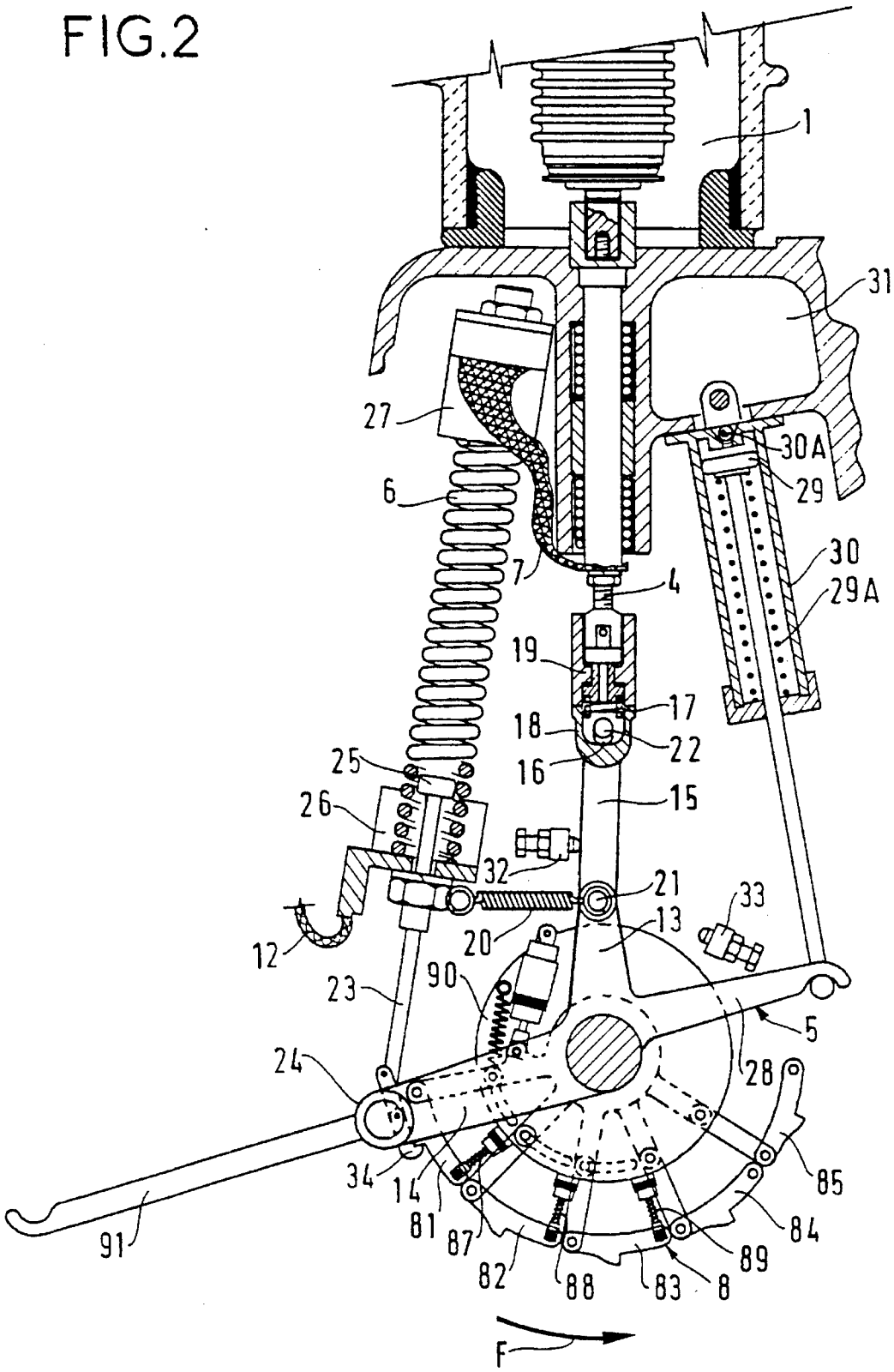
FIG. 2 is a vertical section view through the mechanism of the invention in the closed position.

The displacement device comprises a set of arms comprising a single part that is mounted to rotate together about a horizontal axis. One of the arms 13 is connected to the output of the drive rod 4, and another arm 14 is connected to the SMA spring 6. Arm 13 is connected to the drive rod 4 via a connection rod 15 pivotally mounted at one of its ends on arm 13 and at its other end in a unit provided with an oblong hole 16 and with a compression spring 17. The oblong hole 16 is provided in a guided part 18 that is guided vertically in a guide 19 which is rigidly fixed to the end of the drive rod 4, the guided part 18 being urged downwards by the compression spring 17. The pivot pin 21 between arm 13 and the connection rod 15 is connected to the end of a traction spring 20 whose other end is fixed to a fixed point. In the closed position, as shown in FIG. 2, pin 21 is pulled by the traction spring 20 slightly to the left of the vertical axis that forms the longitudinal axis of the interrupting chamber 1, and that intersects the axis of rotation of the arms 13 and 14. Pivot 22 is then pushed to the top of the oblong hole 16. In this position, the connection rod 15 is in abutment against a fixed abutment part 32.

The end of the other arm 14 is connected to the free end of a rod 23 that is mounted to slide inside the SMA spring 6. At that link, the other arm 14 carries a roller 24 and a catch 34 mounted to pivot about a horizontal axis, both the roller and the catch co-operating with the sequencer device 8 as explained below. At its end that is inside the SMA spring 6, the rod 23 carries an abutment 25 that engages an end part 26 secured to the SMA spring 6. The other end of the spring 6 is connected to a fixed support portion 27.

The displacement device forms a snap-acting mechanism toggling on either side of the dead center constituted by the vertical axis that forms the longitudinal axis of the interrupting chamber 1, and that intersects the axis of rotation of the arms 13 and 14. In the first position shown in FIG. 2, the displacement device pushes the moving contact of the interrupting chamber 1 to the closed position. The abutment part 32 is adjustable and enables the opening force to be calibrated.

A third arm 28 is also part of the set of arms including arms 13 and 14. The third arm is connected to a piston rod 29 urged by a return spring 29A. By sliding inside a fixed cylindrical chamber 30 fed with gas (preferably air) in a closed circuit via a bellows unit or the like, the piston rod compresses the gas in a compression volume 31 provided inside the casing 9 via a non-return valve 30A. Operation of the piston 29 and of the compression chamber 30 is described below.

Figure 3:
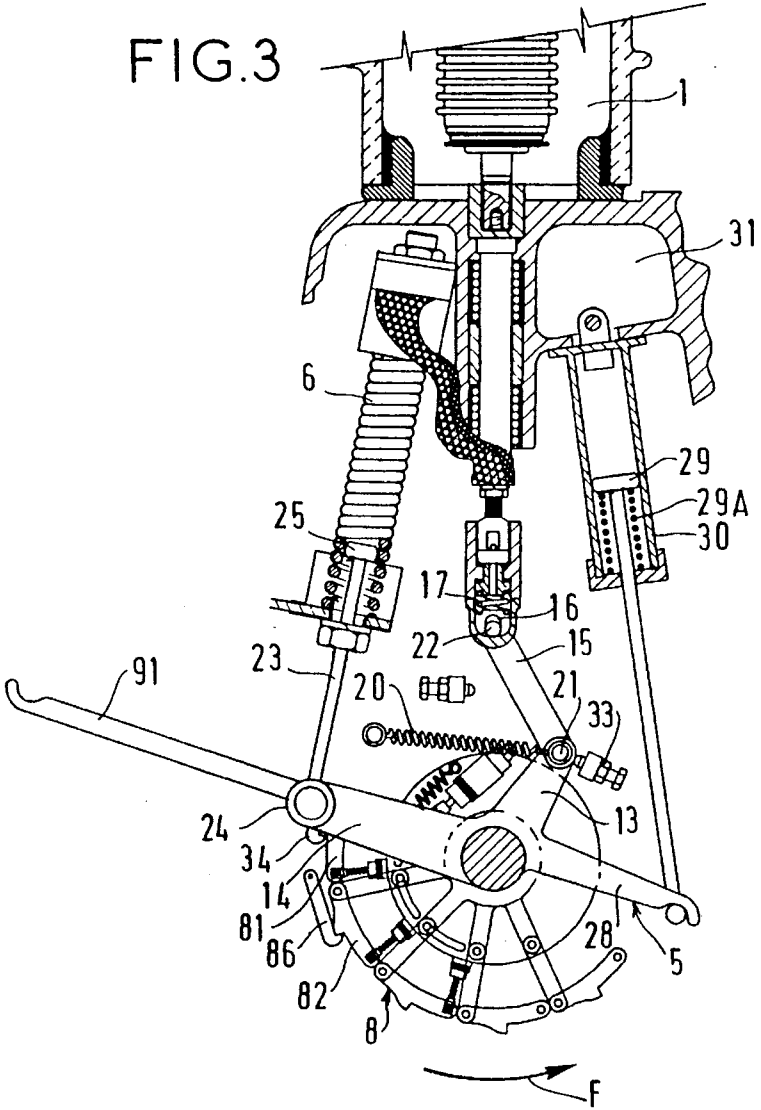
FIG. 3 is a vertical section view through the mechanism of the invention in the newly-opened position.

When a fault current occurs that exceeds the surge current threshold, the SMA spring 6 goes into its austenitic phase, and takes up its compressed shape as shown in FIG. 3. In this way, it pulls rod 23 via its end abutment 25, thereby rotating the set of arms 13, 14, and 28 against the force of the traction spring 20 until the connection rod 15 and/or arm 13 come into abutment with a second fixed abutment part 33. During this displacement, pivot 22 is displaced inside the oblong hole 16, and spring 17 is relaxed. In this way, accelerated motion is achieved by means of the inertia of the moving masses. Abutment 33 is preferably made of a shape memory alloy, and it converts the kinetic energy into heat, thereby minimizing the effects of any bouncing of the moving contact in the chamber 1. By means of the accumulated kinetic energy, the moving contact is displaced and the interrupting chamber 1 is opened at a relatively high instantaneous speed, e.g. about 1 meter per second (m/s). By means of the toggle mechanism having a thrust spring 17, maximum opening speed is guaranteed when the surge current threshold is exceeded, and the SMA spring 6 is therefore heated for a limited time only.

Figure 4:
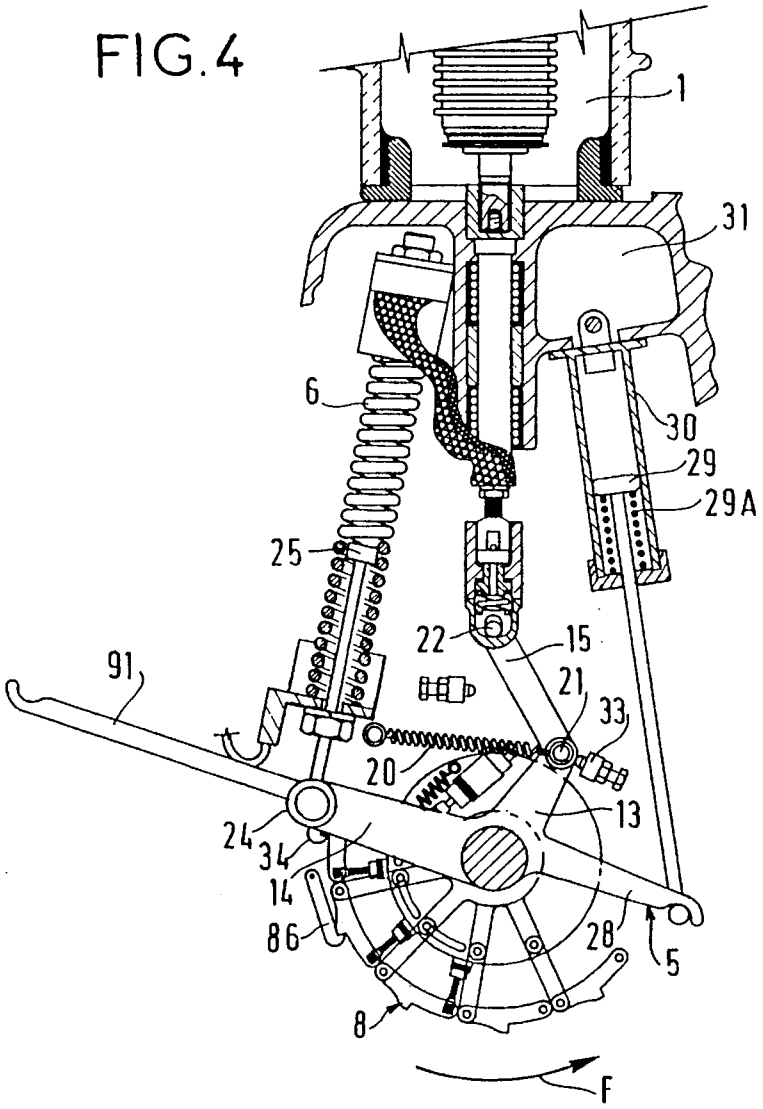
FIG. 4 is a vertical section view through a detail of the mechanism of the invention in the open position.

Since the chamber 1 is then open, the current flowing through the line is interrupted, and the SMA spring 6 cools until it takes up its relaxed shape as shown in FIG. 4.

The sequencer device 8 then comes into action.

As shown in the figures, the sequencer device 8 includes three retractable cams 81, 82, 83, and two non-retractable end-of-stroke locking cams 84, 85 lined up around a rotary wheel subjected to a return spring (not shown) tending to rotate the wheel in the direction of arrow F. A catch 86 mounted to pivot about a fixed axis retains one of the cams against the action of the return spring.

Each of the first three cams 81, 82, 83 is retractable via respective time-delay means constituted by a pneumatic actuator 87, 88, 89, as explained below.

In the closed position, as shown in FIG. 2, catch 34 on rod 23 and the fixed catch 86 engage the first cam 81 in traction, and the roller 24 of rod 23 engages the first cam 81 in thrust.

On compression of the SMA spring 6 and on opening of the chamber 1, as shown in FIG. 3, rod 23 is pulled by the spring 6, and the catch 34 pulls on the first cam 81, thereby rotating the wheel of the sequencer device in the opposite direction to arrow F. The fixed catch 86 then engages the second cam 82, thereby maintaining the wheel in the second position.

Once the SMA spring has become relaxed again, as shown in FIG. 4, spring 20 tends to rotate arm 14 in the direction of arrow F, but arm 14 is locked by the roller 24 pushing against the first cam 81 retained by actuator 87. This actuator is provided with an air outlet orifice that is calibrated to delay retraction of the cam 81, e.g. by a lapse of time of about 2 seconds.

Figure 5:
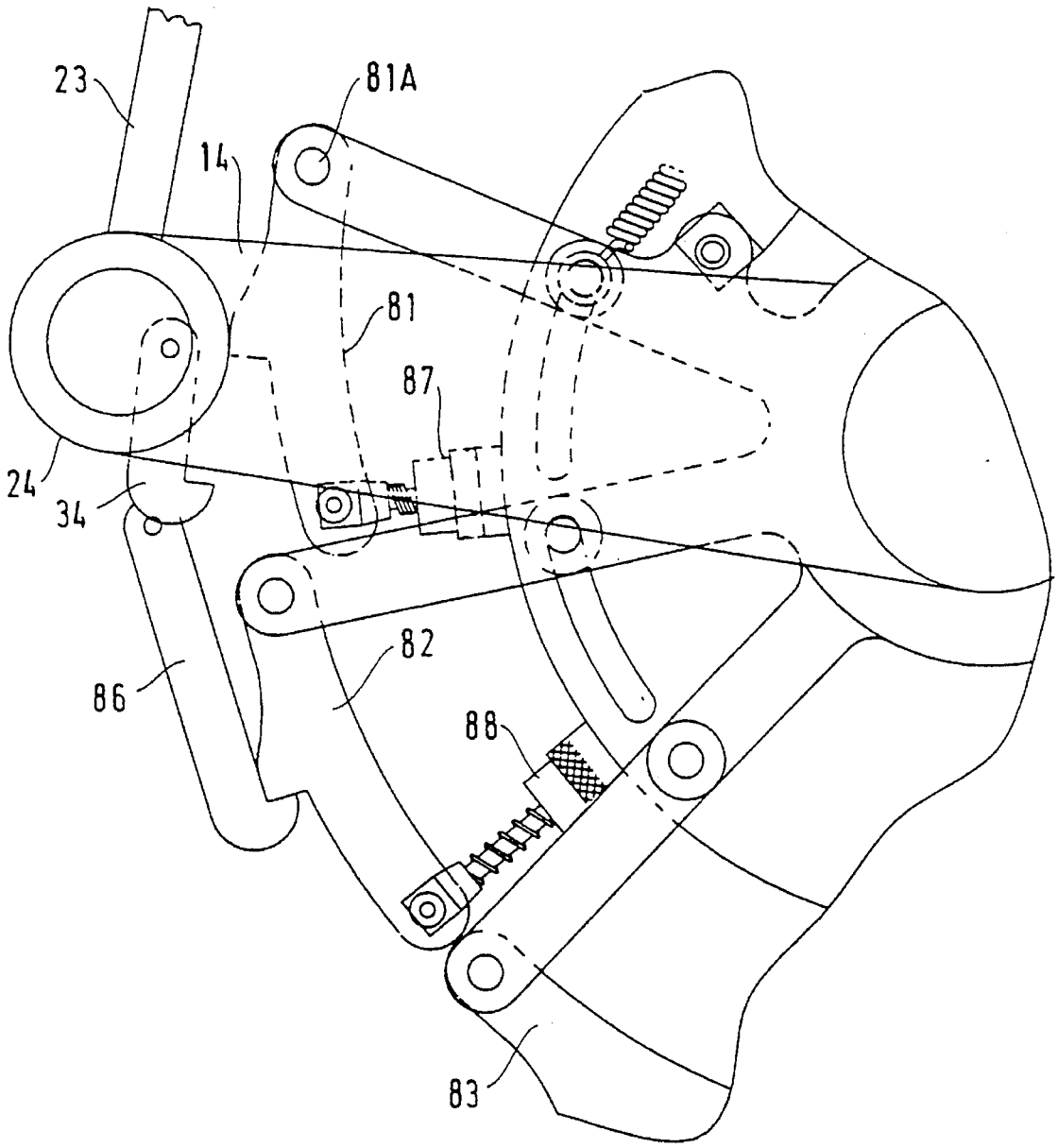
FIG. 5 is a vertical section view through a detail of the mechanism of the invention during first closure.

This situation is shown in detail in FIG. 5. After said lapse of time, actuator 87 releases cam 81 which is retracted towards the inside of the wheel by pivoting about pin 81A. The roller 24 then goes past the first cam 81 since arm 14 is rotated by the action of spring 20. The rotation then continues until the connection rod 15 comes into abutment against the abutment 32 and catch 34 engages cam 82, as shown in FIG. 6.

Figure 6:
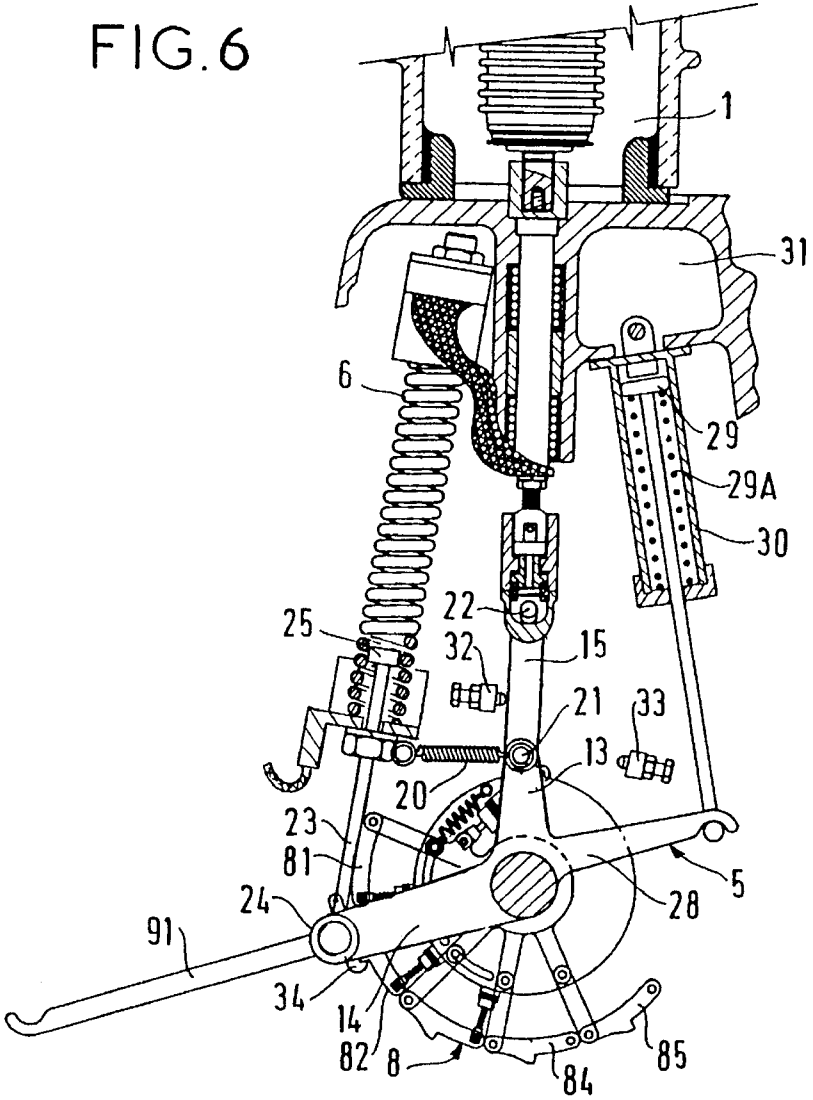
FIG. 6 is a vertical section view through the mechanism of the invention in its end-of-first-closure position.

Once the position shown in FIG. 6 has been reached in this way, the set of arms 14, 13, 28 have returned to their initial position. In that position, to begin with, the moving contact 1 of the chamber 1 is pushed back to the closed position, then, by means of the accumulated kinetic energy, spring 17 is re-compressed, and the displacement device 5 goes back across the dead center. The first time-delayed closure is achieved in this way.

Figure 7:
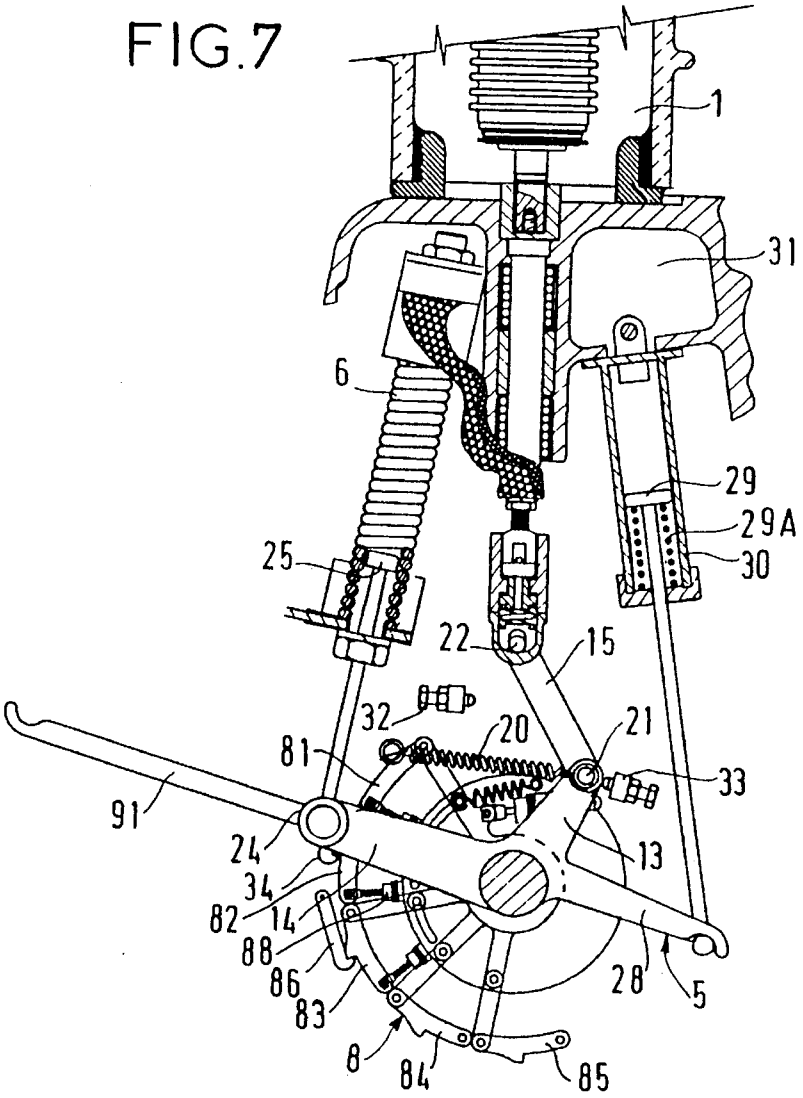
FIG. 7 is a vertical section view through the mechanism of the invention in the second opening position.

The SMA spring 6 is connected to the line once more, and if the fault current is still present, the spring starts being heated again, and starts changing shape, and the above-described opening stage begins again as shown in FIG. 7. This time, it is the second cam 82 that is pulled by the catch 34 on the rod. The fixed catch 86 engages the third cam 83. The next time the SMA spring 6 cools, time-delay actuator 88 provided with an air outlet orifice, e.g. set at 10 seconds, regulates retracting cam 82, and returning the chamber 1 to the closed position.

Figure 8:
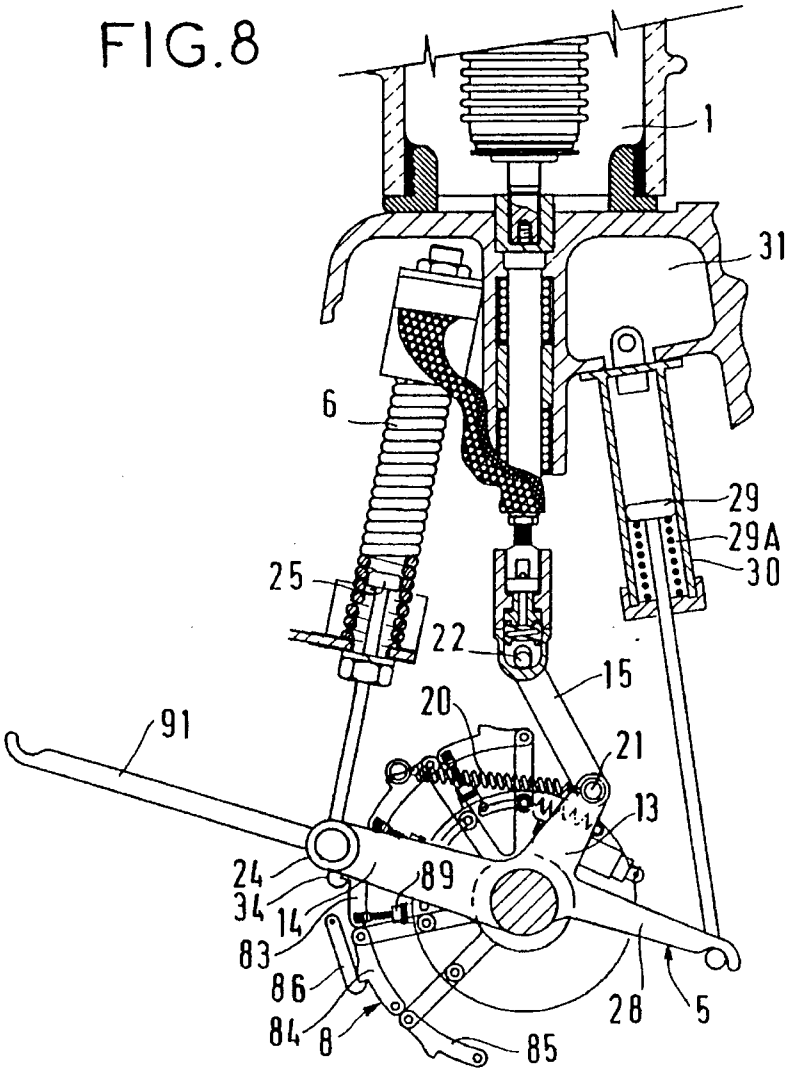
FIG. 8 a vertical section view through the mechanism of the invention in the third opening position.

If the fault current is still present, the opening and closing stages start again in the same way, the opening stage being shown in FIG. 8. The third cam is displaced and actuator 89 delays retraction thereof, by 20 seconds, for the purpose of re-closure, the fixed catch 86 retaining the non-retractable fourth cam 84.

Figure 9:
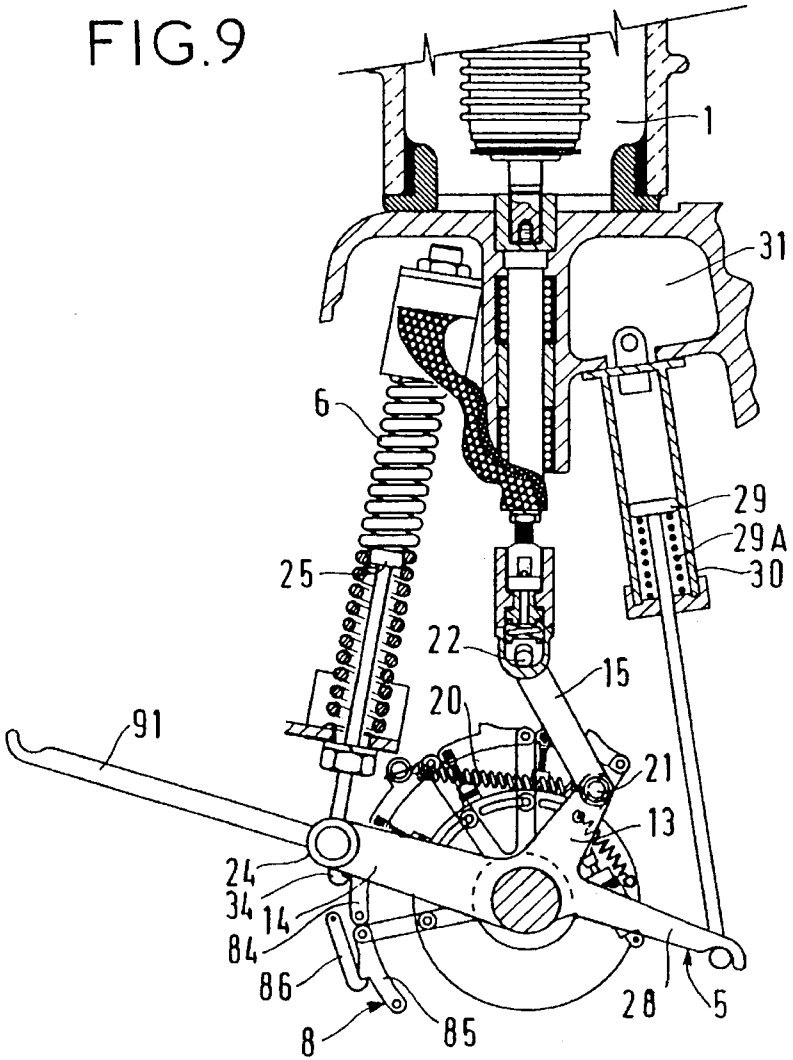
FIG. 9 is a vertical section view through the mechanism of the invention in the locked fourth open position.

If the fault current is still present, the opening and locking stage takes place. The opening stage is identical to the preceding opening stages, but once the SMA spring 6 has cooled and returned to its relaxed position, as shown in FIG. 9, non-retractable cam 84 blocks the roller 24 and the mechanism is locked in the chamber open position.

Figure 10:
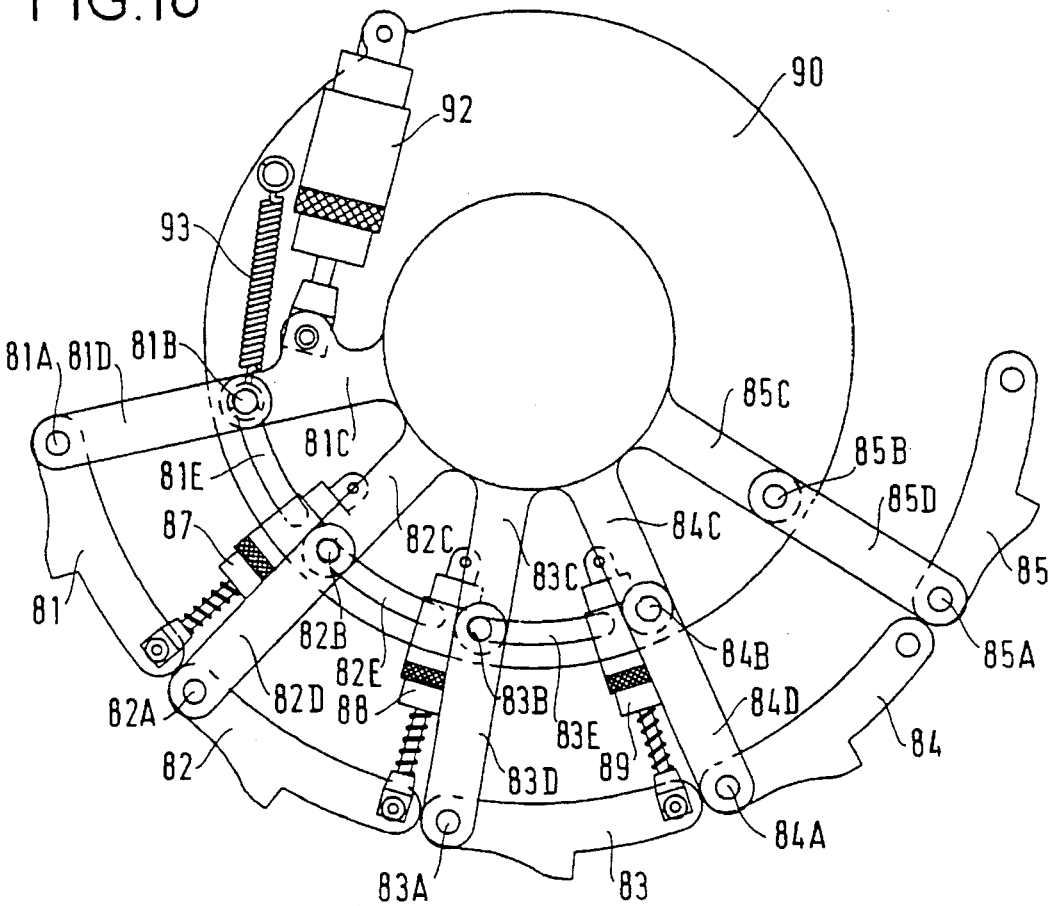
FIG. 10 is a vertical section view through a detail of the sequencer device of the mechanism of the invention.

In the above-described example in which the fault current has given rise to four opening stages, the mechanism is locked and it is then reset manually. For this purpose, as shown in FIG. 10, the cams are coupled to a disk 90 that is secured to a lever 91. The disk 90 is mounted to rotate about the same horizontal axis as the wheel supporting the cams 81 to 85. The cams are supported via respective pivots 81A to 85A at the ends of spokes of the wheel, with the spokes also having respective intermediate hinges 81B to 85B connected to the disk 90. More precisely, a respective intermediate support arm 81D to 85D is mounted to pivot about a horizontal axis at the end of each fixed spoke 81C to 85C of the wheel, and each cam is pivotally connected to the end of a respective intermediate arm. In the operating position, the intermediate arms 81D to 83D are retained in alignment with the fixed spokes 81C to 83C by means of thrust from the time-delay actuators 87 to 89. The rod of each actuator is connected to that end of each of the retractable cams 81 to 83 which is opposite from the end that is mounted to pivot about the corresponding one of the pivots 81A to 83A. Each of the locking cams 84 and 85 is retained pivotally at its free end on a fixed support (not shown).

Figure 11:
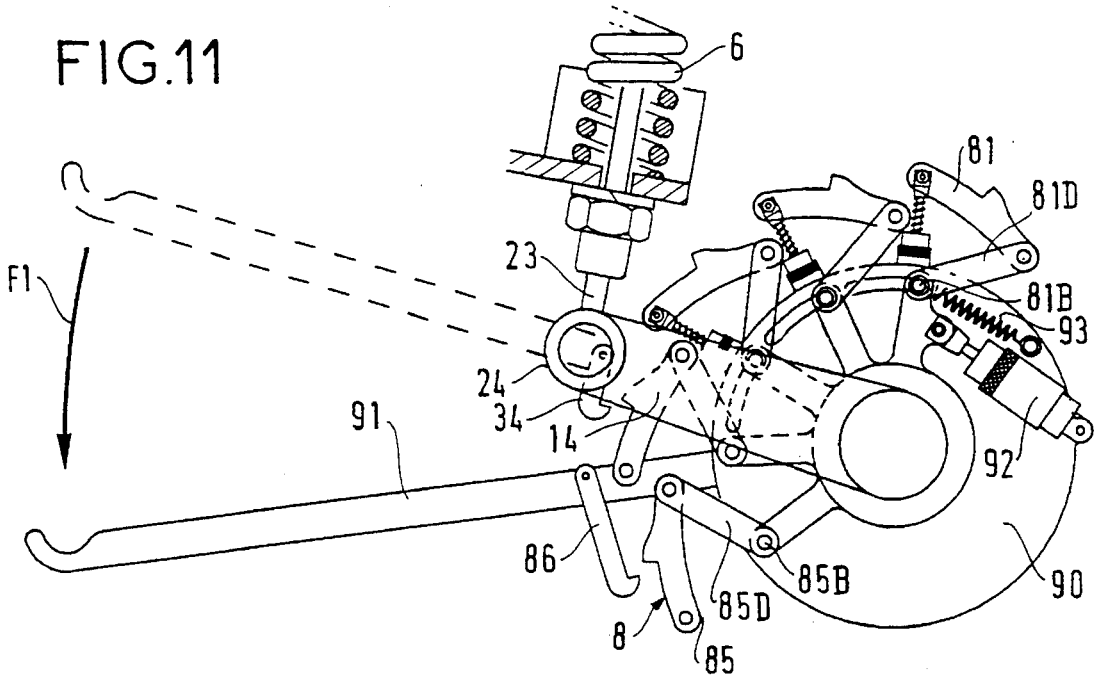
FIG. 11 is a vertical section view through a detail of the sequencer device of the mechanism of the invention during manual resetting.

When an operator pulls the lever 91 downwards, as shown in FIG. 11, the disk 90 and therefore the hinges 81B to 85B which are coupled thereto rotate in the direction of arrow F1. In this way, the arms 81D to 85D are displaced towards the inside of the wheel, and the cams 81 to 85 are disengaged, thereby releasing the fixed catch 86, catch 34 and the roller 24. The displacement device is released and it re-close the chamber 1, and the return spring urging the cam-support wheel rotates it in the direction of arrow F so as to return it to the initial position shown in FIG. 2.

In the event that the fault current disappears during the above-described stages, then, during the following re-closure stage, a surge current no longer passes through the spring SMA 6, so the spring no longer takes up its compressed shape, and the chamber 1 remains closed. The line then operates normally, and it is merely necessary to reset the sequencer device to return to the initial position shown in FIG. 2. The mechanism is provided with an automatic resetting unit for performing this operation.

Figure 12:
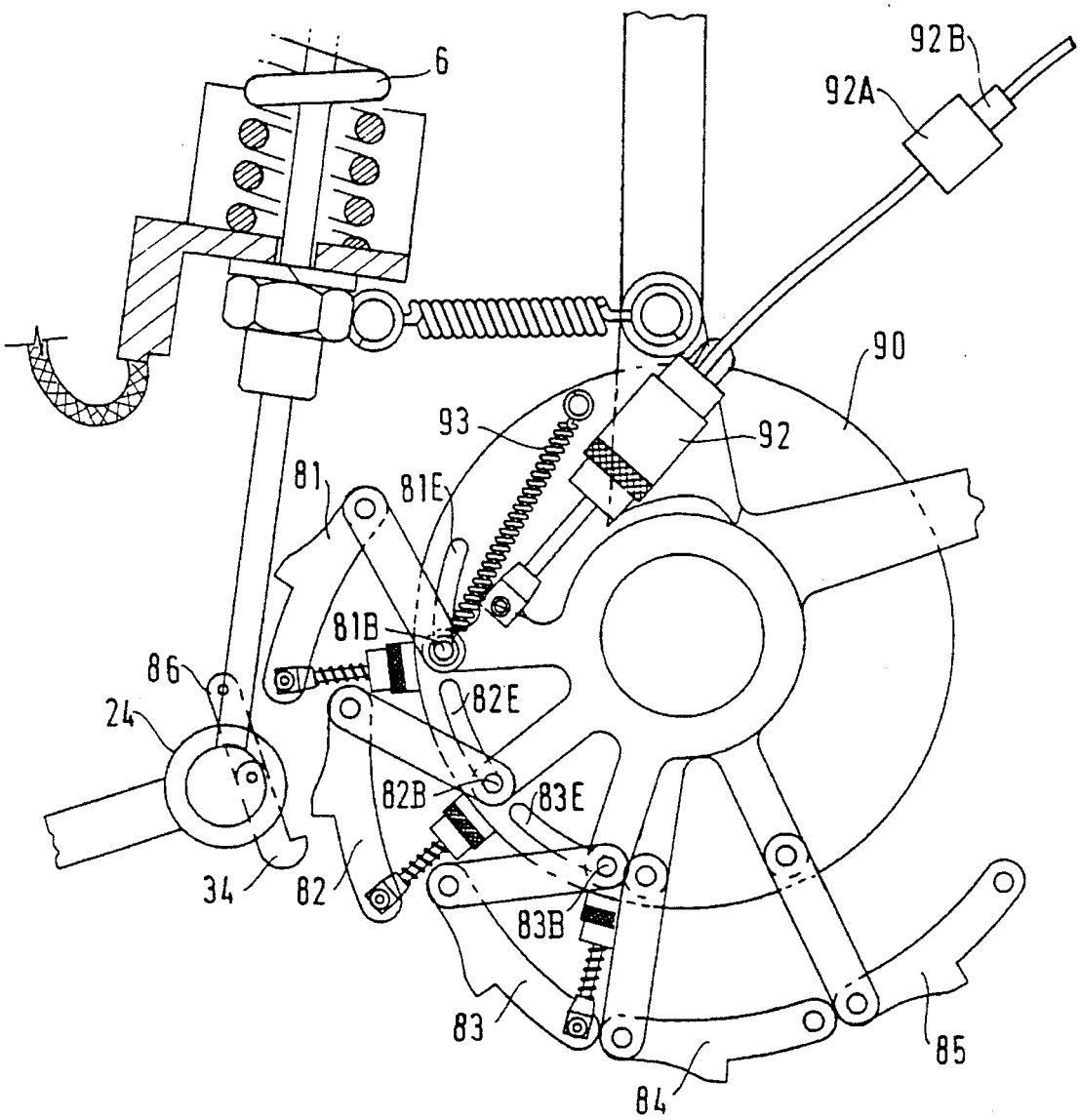
FIG. 12 is a vertical section view through a detail of the sequencer device of the mechanism of the invention during automatic resetting.

The automatic resetting unit includes above-described piston 29. By sliding inside the fixed cylindrical chamber 30, the piston compresses the gas in the compression volume 31. This compression takes place each time the chamber 1 opens. A time delay that is slightly longer than the total time lapse of the time-delayed sequences is achieved by means of a valve 92A controlled by a pneumatic time-delay member 92B, and connected via a pipe both to the compression volume 31 and to an actuator 92. After this time delay, the compressed Gas feeds actuator 92 (shown in FIG. 10). Actuator 92 is fixed to the disk 90 and its rod is coupled to the wheel supporting the cams 81 to 85. By being fed with pressure, actuator 92 causes the wheel to rotate, and cams 81 to 83 are displaced inwards, as shown in FIG. 12, hinges 81B to 83B being slid along oblong slots 81E to 83E provided in the disk 90. In this way, catches 34 and 86, and the roller 24 are released, and the wheel of the sequencer returns to its initial position under the action of its return spring. A spring 93 then returns the cams to the active position.

It should be noted that such automatic disengagement only needs to be provided for the retractable cams 81 to 83 as shown in FIG. 12, since the cycle is interrupted before the last two cams 84 and 85 perform locking. Therefore, the support wheel is advantageously formed by two distinct portions, namely one portion carrying the three retractable cams 81 to 83, and another portion carrying the two locking cams 84 and 85, with the automatic resetting unit concerning the first three cams 81 to 83 only.

I claim:

1. An actuating mechanism for actuating a moving contact of a protective interrupting chamber, said interrupting chamber being installed on a high-voltage or medium voltage power line and being opened when a current in excess of a surge current threshold flows through said voltage line, the mechanism comprising:

a displacement device coupled to the contact for displacing the contact to effect opening and closing of the interrupting chamber;

a drive member for driving the displacement device, the drive member being a conductive helical spring made of a shape memory alloy and being electrically coupled to the voltage line, the alloy going from its martensitic phase to its austenitic phase when a current in excess of said surge current threshold passes through the spring heating said spring thereby displacing the contact and opening the interrupting chamber; and a sequencer means coupled to the displacement device for re-closing the interrupting chamber, the sequencer means including time delay means providing an adjustable and timed opening and closing cycle for operating the sequencer means.

2. An actuating mechanism according to claim 1, wherein the displacement device, having an axis of rotation, rotates from a first position, where the displacement device displaces the contact to a closed position, the first position being on a first side of a vertical line through the interrupting chamber, the vertical line intersecting the axis of rotation of the displacement device, to a second position, the second position being on a second side of the vertical line, where the displacement device in the second position displaces the contact to an open position when the spring is compressed, the spring having a first end connected to a fixed support portion, and and a second end connected to the displacement device via a slidably-mounted rod mounted to slide inside the spring, a first end of said slidably-mounted rod coming into abutment at said second end of the spring when the spring is relaxed.

3. An actuating mechanism according to claim 2, wherein the displacement device comprises a single part having plurality of arms mounted to rotate about the axis of rotation, a first one of the plurality of arms being urged to rotate by a traction spring and being connected to a first end of a pivotally-mounted connection rod, a second end of the pivotally-mounted connection rod being connected to the moving contact via a unit comprising a guided part being guided in a guide rigidly connected to the moving contact, the guided part being urged by a compression spring, the guided part being provided with an oblong hole for slidably carrying a pivot pin of the connection rod, and 2 second one of the plurality of arms being secured to the slidably-mounted rod.

4. An actuating mechanism according to claim 2, wherein the sequencer means comprises:

at least one retractable cam being retractable via time-delay means;

a first catch fixed to a second end of the slidably-mounted rod, the first catch engaging the retractable cam in traction; and a roller also fixed to the second end of the slidably-mounted rod the roller engaging the retractable cam in thrust.

5. An actuator mechanism according to claim 4, wherein the sequencer means further comprises:

a plurality of retractable cams lined up around a rotary wheel, the rotary wheel being connected to a return spring; and a second catch mounted to a pivot about a fixed axis and retaining one of the cams against action of the return spring.

6. An actuating mechanism according to claim 5, wherein the sequencer means further comprises two non-retractable locking cams.

7. An actuating mechanism according to claim 6, wherein the sequencer means further comprises independent means for manually disengaging the retractable cams and the non-retractable cams so as to reset the mechanism at an end of a cycle.

8. An actuating mechanism according to claim 6, wherein the sequencer means further comprises independent means for automatically disengaging the retractable cams so as to reset the mechanism during a cycle, the independent means comprising a pneumatic actuator fed with gas via a valve controlled by a pneumatic time-delay member, via a compression chamber in which a piston coupled to the displacement device is slidably mounted.

* * * * *